United States Patent [19]

Krueger

[11] 4,377,079

[45] Mar. 22, 1983

[54] RING GUARD

[76] Inventor: Peter L. Krueger, 301 W. Sylvania Ave., Neptune City, N.J. 07712

[21] Appl. No.: 171,948

[22] Filed: Jul. 23, 1980

[51] Int. Cl.[3] ..... A44C 9/00

[52] U.S. Cl. ..... 63/15.8

[58] Field of Search ..... 63/15.8, 15.7, 15.4, 63/15, 30, 29 R

[56] References Cited

U.S. PATENT DOCUMENTS

| | | | |
|---|---|---|---|
| 899,296 | 9/1908 | Elliot | 63/29 R |
| 1,178,186 | 4/1916 | Spaney | 63/15.4 |
| 1,245,201 | 11/1917 | Depollier | 63/15.4 |
| 1,596,642 | 8/1926 | Weber | 63/15.7 |
| 1,656,807 | 1/1928 | Lindel | 63/15.4 |
| 2,048,317 | 7/1936 | Berman | 63/15.8 |
| 3,307,375 | 3/1967 | Estrin et al. | 63/15 |

FOREIGN PATENT DOCUMENTS

| | | | |
|---|---|---|---|
| 1001782 | 10/1951 | France | 63/15 |

*Primary Examiner*—F. Barry Shay

[57] ABSTRACT

In a first illustrated embodiment, the Guard comprises a split ring, having a trough formed within the inner surface thereof in which, nestably, to receive a finger-ring. The split ends of the Guard ring have a pair of arcuate, mating elements for circumscribing a finger-ring gem stone or the like, the elements being engageable together to define a circular portion. The outer surfaces of the arcuate elements are threaded to receive an internally-threaded circlet. Finally, a bulbous, hollow shield, having a circular opening, is replaceably fitted onto the circlet; the circular opening of the shield makes a frictional, sliding engagement with the circlet.

3 Claims, 11 Drawing Figures

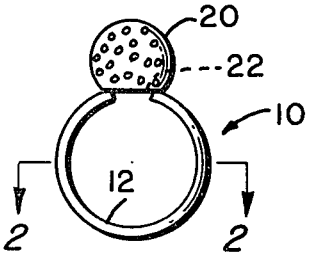
FIG. 1
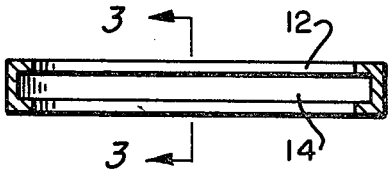
FIG. 2
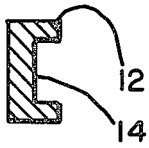
FIG. 3
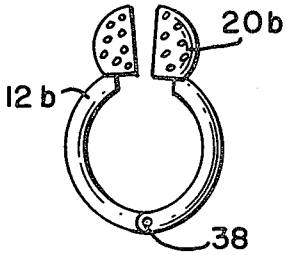
FIG. 9
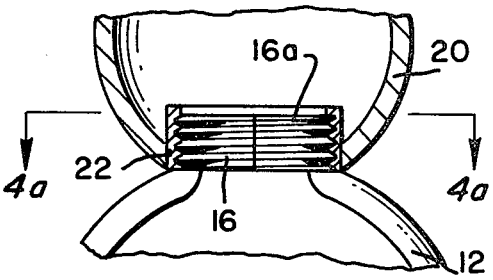
FIG. 4
FIG. 8a
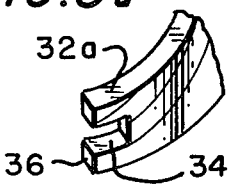
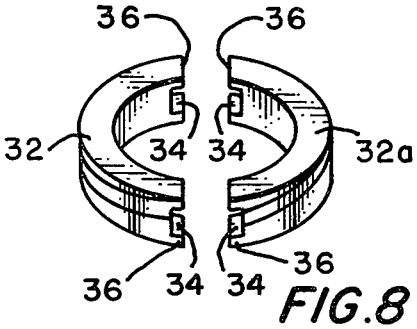
FIG. 8
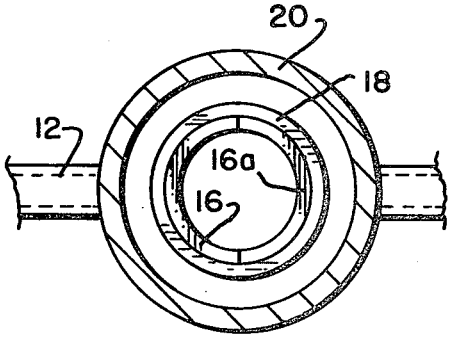
FIG. 4a
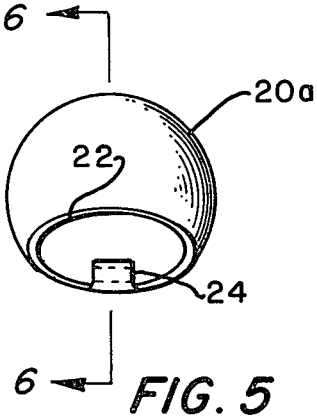
FIG. 5
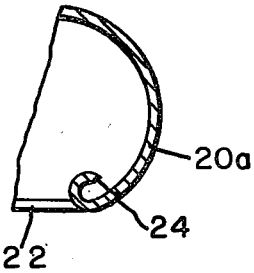
FIG. 6
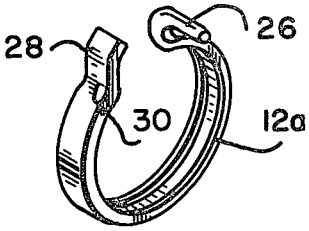
FIG. 7

RING GUARD

This invention pertains to ring guards, and in particular to disguise-type of ring guard; for shieldable protecting and substantially obscuring a finger-ring and any gem stone or the like carried thereupon.

Ring guards, particularly the ring guard of the present invention, serve many purposes. If of proper, thoughtful design, the guard can protect against the loss of a valuable gem stone should the latter happen to be loose in its mounting. The guard will also protect such gem stone, and the finger-ring itself as well, against damage in hostile environments. Additionally, a guard can disguise a valuable ring and gem stone, making it appear that the person wearing same has only so-called "junk" jewelry on her or his finger.

It is an object of this invention to set forth such a proper, thoughtfully designed ring guard, a ring guard which will provide all the aforesaid uses. It is particularly an object of this invention to disclose a ring guard comprising first means for nestably engaging at least a first portion of a finger-ring; and second means for shielding at least a second portion of a finger-ring from the environment; wherein said second means is replaceably engaged with said first means.

Further objects of this invention, as well as the novel features thereof, will become more apparent by reference to the following description taken in conjunction with the accompanying figures, in which:

FIG. 1 is a side, elevational view of an embodiment of the ring guard according to the invention;

FIG. 2 is a cross-sectional view taken along section 2—2 of FIG. 1, the same being in enlarged scale relative to FIG. 1;

FIG. 3 is a cross-sectional view taken along section 3—3 of FIG. 2, the same being enlarged over the scale of FIG. 2;

FIG. 4 is an enlarged, fragmentary view, partly in cross-section, of the upper, gem-mounting area of the guard of FIGS. 1–3;

FIG. **4*a* is a cross-sectional view taken along section 4*a*—4*a* of FIG. 4**;

FIG. 5 is an elevational view of the hollow shield of FIG. 1, the shield being shown slightly tilted away (from the plane of the drawing page), showing an alternative embodiment thereof;

FIG. 6 is a cross-sectional view taken along section 6—6 of FIG. 5;

FIG. 7 is a perspective view of a ring-nesting portion of a ring guard, for use with the shield of FIGS. 5 and 6;

FIG. 8 is a perspective illustration of an alternative embodiment of a ring-engaging and gem stone-circumscribing circlet usable with the shield of FIG. 1;

FIG. **8*a* is a fragmentary view of an end of one of the halves of the circlet or split annulus of FIG. 8, the same being enlarged over the scale of FIG. 8; and FIG. 9** is a side elevational view of yet another alternate embodiment of the invention.

As shown in FIGS. 1–4 and **4*a*, a first embodiment 10 of the ring guard, comprises a split annulus 12 which has formed within the inside surface thereof a trough 14 for nestably receiving therewithin a finger-ring. The split ends of the annulus carry semi-circular elements 16 and 16*a* thereat. The elements are mutually confronting to define, when urged together (as shown), a full circle. The outer surfaces of the elements 16 and 16*a*** are commonly threaded; i.e., the threading thereof is continuous about the circle which the confronting elements define.

A circlet 18 is threadedly engaged with the threading of the elements 16 and **16*a*, and holds the elements in closed or confronting disposition; this is best seen in FIG. 4*a*. A bulbous shield 20, having a circular opening 22 of a diameter slightly larger than the outside diameter of circlet 18**, is frictionally and replaceably fitted onto the circlet.

In use, the shield 20 and circlet 18 are removed from the guard 10, and the split annulus 12 is spread open, slightly, to receive a finger-ring therewithin; if the finger-ring has a gem stone, the latter is positioned between the elements 16 and **16*a*. Then the elements 16 and 16*a* are urged toward each other, and the circlet 18 is threadedly engaged therewith. Finally, the shield 20 is slidably fitted about the circlet 18**.

Any finger-ring, of course, has as annular or ring portion for encircling a finger. Such portion has an inner diametrical surface, which engages the surface of the finger, an outer diametrical surface opposite the inner diametrical surface, and substantially parallel sides which join the aforesaid inner and outer diametrical surfaces. Now, my ring guard embodiment 10, in having the trough 14, receives the outer diametrical surface of the ring portion therewithin, and the sides of the trough 14 parallel the sides of the ring portion. That is, the sides of the trough 14 are astride the sides of the ring portion, so that the sides of the ring portion, and the outer diametrical surface thereof as well, are occluded from view. The shield 20, also, occludes from view any gem stone which is coupled to the finger-ring.

The shield 20, of course, may take any shape which will accommodate a hollow void therewithin and a circular opening 22. Thus, it may appear as a soccer ball, football, or geometric patterns (decahedron, for instance) of various types may be used. The owner of the guard 10 may have any number of replacement shields 20 to use with a common split annulus 12.

FIGS. 5–7 illustrate an alternative embodiment of the novel ring guard, in which the shield **20*a* may be pivotably fixed to the split annulus 12*a*, albeit selectively replaceable. In this, the shield 20*a* has a hinge-type curled tab 24 formed at the edge of the opening 22. The tab 24 slidably engages a short stub shaft 26 which projects from one end of the annulus 12*a*. Thus, the shield 20*a* is hingedly fixed to the annulus 12*a* at the one end thereof. The opposite end of the annulus 12*a* is formed with a serpentine configuration; the latter defines a slide-surface knee 28, for slidable receiving the edge of the opening 22 which is opposite the tab 24, and a shoulder 30 on which to rest said latter edge of opening 22. Clearly, by contracting the annulus 12*a*, the latter edge will come free of the shoulder 30 and knee 28, and can be turned up and about the shaft 26—for slidable disengagement therefrom. Thereafter, a replacement shield 20*a* can be fitted to the split annulus 12*a***.

Usually, the ring guard will be employed principally to protect a gem stone. Now, for this purpose, it may be acceptable to dispense with the split annuli 12 and **12*a*. FIGS. 8 and 8*a* depict the principal component of an alternative embodiment of the ring guard which has no need for an annulus for the finger-ring. This latter embodiment simply comprises a pair of substantially mirror-image, semi-circular elements 32 and 32*a* which, quite like elements 16 and 16*a*, cooperatively define a full circle when brought together. Elements 32 and 32*a*, however, have cut-outs or recesses 34 formed in the ends thereof. When the elements 32 and 32***a* are brought together, they define a pair of apertures, therebetween, within which to receive that portion of a finger-ring which is most adjacent to a gem-stone mounting. Like elements 16 and 16*a*, elements 32 and 32*a* are externally, commonly threaded—but not fully. The uppermost and intermediate annular, outer surfaces thereof are threaded, but the lowermost, annular surfaces thereof are not. This is because the lowermost fingers 36, at the ends of the elements 32 and 32*a*, reach below the finger-ring; threaded engagement thereof with a circlet 18 will not find the circlet proceeding beyond the intermediate, annular surface.

Elements 32 and 32*a*, then, are used with a circlet 18 (FIGS. 4 and 4*a*), and a shield 20 (FIGS. 1 and 4). The circlet 18 holds the elements 32 and 32*a* fast to the finger-ring, and prevent them from separating from each other.

In a further, alternate embodiment (FIG. 9), the split annulus 12*b* has a hinge 30 and a split bulbous shield 20*b* diametrically opposite which can be snapped shut over the protected gem.

While I have described my invention in connection with specific embodiments thereof it is to be clearly understood that this is done only by way of example, and not as a limitation to the scope of my invention, as set forth in the objects thereof and in the appended claims.

I claim:

1. For a finger-ring having (a) an annular portion with (1) an outer diametrical surface, (2) an inner diametrical surface, and (3) substantially parallel side surfaces joining said diametrical surfaces, and (b) a gem stone, or the like, coupled to said annular portion, a ring guard, comprising:

first means for nestably receiving therein substantially all of the annular portion of a finger-ring, and for occluding from view the outer diametrical surface, and the parallel side surfaces of such finger-ring; and second means replaceably coupled to said first means for wholly enveloping, and occluding from view, a gem stone or the like coupled to said annular portion of such finger-ring; wherein said first means comprising a substantially circular element having a transverse separation formed therein, and a pair of confronting, semi-circular components fixed to said element, with one of said components fixed at one side of said separation, and the other of said components fixed at the opposite side of said separation, and a circlet replaceably and surroundingly engaging said components;

said second means comprising a hollow shield having one opening formed therein; and said shield being replaceably and surroundingly engaged with said circlet, said opening of said shield circumscribing said circlet.

2. A ring guard, according to claim 1, wherein:

said semi-circular components have outermost surfaces with threading formed therein, said threading of one of said components being complementary to and continuous of said threading of said other of said components;

said circlet has an inner diametrical surface with threading formed therein; and said circlet is threadedly engaged with said semi-circular components.

3. A ring guard, according to claim 2, wherein:

said shield is of bulbous configuration, and is frictionally engaged with said circlet.

* * * * *